US006213344B1

(12) United States Patent
Hill

(10) Patent No.: US 6,213,344 B1
(45) Date of Patent: Apr. 10, 2001

(54) FOLDING AND STACKING CONFIGURATION FOR WET WIPES

(75) Inventor: Simon David Julien Hill, Wiesbaden (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/424,476

(22) PCT Filed: May 18, 1998

(86) PCT No.: PCT/US98/10162

§ 371 Date: Nov. 23, 1999

§ 102(e) Date: Nov. 23, 1999

(87) PCT Pub. No.: WO98/52453

PCT Pub. Date: Nov. 26, 1998

(30) Foreign Application Priority Data

May 23, 1997 (EP) ..... 97108388

(51) Int. Cl.[7] ..... B65H 3/00

(52) U.S. Cl. ..... 221/38; 221/46; 221/49; 221/197

(58) Field of Search ..... 221/38, 46, 48, 221/49, 47, 197

(56) References Cited

U.S. PATENT DOCUMENTS 1,403,709 10/1922 Wheeler .
2,772,021 * 11/1956 Kettles .
3,207,360 * 9/1965 Scott ..... 221/48
3,330,553 * 7/1967 Couzens et al. .
4,138,034 * 2/1979 McCarthy ..... 221/48
4,638,921 * 1/1987 Sigl et al. ..... 221/48 X
4,725,469 * 2/1988 Summerfield ..... 221/48 X
4,778,048 * 10/1988 Kaspar et al. .
4,863,064 * 9/1989 Dailey, III ..... 221/48
5,332,118 7/1994 Muckenfuhs ..... 221/48
5,497,903 3/1996 Yoneyama ..... 221/48
5,540,332 * 7/1996 Kopacz et al. .
5,964,351 * 10/1999 Zander ..... 221/48 X

FOREIGN PATENT DOCUMENTS 0 747 313 A1 12/1996 (EP) .
0747313 * 12/1996 (EP) .

* cited by examiner

*Primary Examiner*—David H. Bollinger
(74) *Attorney, Agent, or Firm*—David M. Weirich; Eileen L. Hughett; Steven W. Miller

(57) ABSTRACT

The present invention relates to wet wipes (1) for use in wiping surfaces in the home and in industry, in addition to their use on the human body such as for baby wipes, make-up removal and other skin care applications. The wet wipes are folded and interleaved with one another (40, 50) to provide an improved stacking configuration whereby each wipe can be readily singly separated from the wet wipe stack by the consumer.

13 Claims, 5 Drawing Sheets

FOLDING AND STACKING CONFIGURATION FOR WET WIPES

FIELD OF THE INVENTION

The present invention relates to stacks of wet wipes which are provided with an improved interfolding and interleaving configuration, such that each wipe can be readily separated from the wet wipe stack by the consumer.

BASCKGROUND OF THE INVENTION

Wet wipes are typically premoistened, disposable towelettes which may be utilised in a variety of applications both domestic and industrial and perform a variety of functions. Wet wipes are typically used to wipe surfaces both animate and inanimate, and may provide numerous benefits such as cleaning, cleansing, disinfecting, and skin care benefits.

One particular application is the use of wet wipes for wiping parts of the human body particularly when wash water is not available, for example when traveling. Wipes are commonly used for human cleansing and wiping such as anal, perineal cleansing and genital cleansing and face and hand cleansing for example as intimate hygiene wipes such as feminine wet wipes. Wet wipes may also be used for application of substances to the body including removing and applying of make-up, skin conditioners and medications. Another application of wipes is during diaper changes and also for the treatment of adult and baby dermatitis partly caused by the use of diapers and incontinence devices. In addition wet wipes are also applicable for wiping and or cleaning other surfaces or for the application of compositions to surfaces, for example kitchen and bathroom surfaces, eyeglasses, shoes and surfaces which require cleaning in industry for example surfaces of machinery or automobiles. Wet wipes also include articles used for the cleaning or grooming of pets.

Wet wipes are commonly constructed of combinations of synthetic and natural fibres, such as polyolefin fibres, viscose fibres and cotton fibres, which are generally moistened with an aqueous composition which contains amongst others surfactants, preservatives, oils and scents. The wet wipes are then typically provided in a folded stacked configuration within a covered container such as a tub-like container having a lid. Alternatively, the wipes may be provided in tub containers having a dispensing aperture. In both cases this allows easy transportation and storage of the wipes.

However, a problem with the current stacking of folded wet wipes is the lack of easy, single wipe dispensation from the wet wipe stack. This problem is particularly acute in circumstances of use such as when a consumer is holding a baby during a diaper change. Under such conditions the consumer needs to be able to pick up and separate the wipe from the stack using only one hand. This is not achieved satisfactorily with current products.

The problem of the lack of satisfactory wet wipe dispensation from the stack and container is due to a number of reasons. Firstly, wet wipes are typically folded and either placed one on top of the other or interleaved with an adjacent wipe. However, the exact location of the leading edge of the upper most wipe of the current stack is not easily identifiable, either visually or tacitly. This is because the substrate material of the wipe is typically homogeneous and thus the leading edge of the wipe, particularly when folded, cannot be distinguished from the wipe substrate material on which it rests. In addition, the leading edge portion of the wipe also has a tendency to adhere to the underlying wipe substrate material on which it rests. Hence even tactile identification of the edge by running or dragging of the fingers across the wipe surface does not immediately result in the identification of the location of the edge.

Secondly, once the leading edge has been located, it is difficult for the consumer to grasp hold of sufficient substrate material and maintain grasp thereof, in order to separate a single wipe from the stack upon which it rests. The consumer often is only able to grasp a small portion of the leading edge such that a tight grip thereof is not established and hence the wipe easily slips from the fingers of the consumer.

These problems associated with wet wipe dispensation have been recognised in the art. For example U.S. Pat No. 5,540,332 addresses dispensability of wet wipes and a method of producing these wipes. The improved dispensability is achieved by providing at least a portion of one of the end edges of the wipe with a repeating non-linear pattern such as a sine wave configuration. However, the problem of single wet wipe dispensation is neither addressed or overcome by the use of a non linear leading edge.

Another proposed solution to the dispensing problem is described in U.S. Pat. Ser. No. 4,778,048, which discloses a product comprising a stack of wet wipes tilted on edge within a container for improved access, dispensing and equal liquid distribution. In a preferred embodiment, the edge of each wipe has a Gurley Stiffness greater than the stiffness of the main body of the wipe. However, the provision of such a stiff edge is in itself undesirable characteristics of a wet wipe. Wet wipes, particularly those intended for use on sensitive areas of the skin such as baby wipes require a certain degree of softness. The edge of the wipe which is stiffened is no longer suitable for use as is indeed recognised in the patent itself, and hence the wipes have a reduced substrate surface suitable for use. Also care needs to be taken to reduce or avoid contact of this edge portion with the skin as it may cause irritation. Moreover, the stiffness of the edge again does not solve the problem of single wipe dispensation. In addition, the provision of such a non linear edge on a nonwoven substrate using current manufacturing techniques would also result in the fraying of the edges of the substrate which is also highly undesirable.

Alternatively, it has also been proposed to provide specifically designed dispensing containers having dispensing orifices in order to aid in the identification of the leading edge by the consumer. These containers are designed such that during the removal action of the upper most wipe from the container, the adjacent wipe is elevated from the stack such that it partially protrudes through the orifice once the upper most wipe has been removed. In this manner the uppermost wipe is positioned for easy grasp by the consumer. However, a disadvantage with such devices is that too much substrate material of the adjacent wipe is exposed through the orifice. Accordingly, the wipe becomes dry and unsuitable for use and has to be discarded. EP 747 313 proposes a means to address this problem and discloses a multiple folded paper, such as wetted tissue paper, for continuous disposal through a container orifice. In this manner a maximum of a quarter of the length of the adjacent wipe is exposed through the dispensing orifice. However, such paper tissue products cannot be utilised for all wet wipe applications, such as baby wipes as the wetted tissue paper is not satisfactory in terms of softness or strength. In particular, such wetted tissues suffer from a tendency to tear during use and hence are not suitable for use as wet wipes.

Another key contributory factor to the problem of single wet wipe dispensation from the wet wipe stack which is not addressed by any of the foregoing prior art, is the tendency of the wipe substrate material to adhere to itself. In particular, this is due to the compression of the wipe stacks during manufacture and storage, the actual weight of the stack of wipes themselves, and the existence of attractive forces in-between the substrate material and the lotion of the wipes. As a result, when the wipes are folded to form a stack, the substrate material tends to adhere to itself and the substrate material of adjacent wipes. Consequently, once the consumer has raised the wipe from the stack, the wipe tends to maintain its folded configuration. Moreover, the wipe typically remains at least partially adhered to the adjacent wipe on which it was resting. Hence, in addition during the action of wipe removal from the stack, the adjacent wipe is also at least partially separated from the stack. As a result the consumer is required not only to unfold the wipe before commencing with the desired application of the wipe but also, to separated it from the adjacent wipe in the stack and returned this wipe to the stack in the container. This is obviously particularly inconvenient to consumers utilising baby wipes during diaper changes.

The problem of substrate wipe adhesion has been recognised in the prior art. Attempts at resolving this problem have typically resided in the provision of interleaved wipes as for example described in JP 08 089 439. Indeed interleaving is also known in the prior art related to dry tissue products such as disclosed in U.S. Pat. No. 2,772,021 and U.S. Pat. No. 3,330,553. However due to complex interactions that exist between substrate material and lotion in the wet wipe product, it is known that the folding configurations generally utilized in such dry tissue products cannot be reapplied to wet wipes.

Furthermore, many of the proposed interleaving configurations have associated problems therewith. In particular, when as a result of interleaving the degree of overlap of substrate material between adjacent wipes is large, then the problem of substrate adhesion is merely exacerbated such that the wipes are effectively always released in pairs, or although the wipe is dispensed singly, a large proportion of an adjacent wipe may still be exposed through the dispensing orifice after the removal of the upper wipe, such that the wipe becomes dry. On the other hand, if the overlap between adjacent wipes is minimised such that single wipe dispensation is guaranteed, there is no recognisable separation of the adjacent wipe from the stack and the problem of leading edge identification reappears.

Furthermore, in addition to the unsatisfactory dispensation of the wipes, other problems related to the proposed prior art interleaving configurations may also arise. For example, as a result of the interleaving configurations the substrate material may be unevenly distributed in the container, which leads to a number of undesirable effects such as uneven lotion distribution throughout the stack of wipes and within the individual wipes themselves resulting in concentration of the lotion at specific areas within the stack. Moreover, many of the interleaving configurations also result in the formation of ridges and grooves in the substrate material, which both tends to reduce the strength and softness of the wipe in addition to being aesthetically undesirable.

It is therefore desirable to provide a wet wipe substrate which is suitable for multiple applications such as baby wipes, which are strong, soft and absorbent. It is further desirable to provide a stacking configuration for such wet wipes which faciliates easy, single wipe dispensation from the wipe stack.

The present invention addresses these problems by providing a stack of wet wipes which have an improved folding and interleaving configuration.

SUMMARY OF THE INVENTION

The present invention hence relates to a wet wipe for wiping parts of the human body such as baby wipes and other surfaces. In particular, the present invention relates to a stacking configuration for wet wipes so as to facilitate ease of dispensation and separation of a single wipe from the stack of wet wipes, especially for applications utilising a container and dispensing orifice.

Accordingly, the wet wipe stacking configuration comprises a first assembly of wipes and a second assembly of wipes, each of the wipes comprising a substrate and a liquid composition. Each of said wipes extends lengthwise from a first leading end edge to a second trailing end edge and has at least two folds thereby providing, a leading edge panel, a central panel and a trailing edge panel.

According to the present invention, said first assembly of wipes is interleaved said second assembly of wipes, such that at least a portion of said central panel and at least a portion of said trailing edge panel of each of said first assembly of wipes are interleaved between at least a portion of said leading edge panel and at least a portion of said central panel of one wipe of said second assembly of wipes. Similarly, at least a portion of said central panel and at least a portion of said trailing edge panel of each of said second assembly of wipes are interleaved between at least a portion of said leading edge panel and at least a portion of said central panel of one wipe of said first assembly of wipes. In addition the wipes are interleaved such that the length of said leading edge panel or said trailing edge panel of each of said first assembly of wipes is no more than 50% of the length of the corresponding central panel, and such that the length of said leading edge panel or said trailing edge panel of each of said second assembly of wipes is no more than 50% of the length of the corresponding central panel.

DETAILED DESCRIPTION OF THE INVENTION

Figure 1:
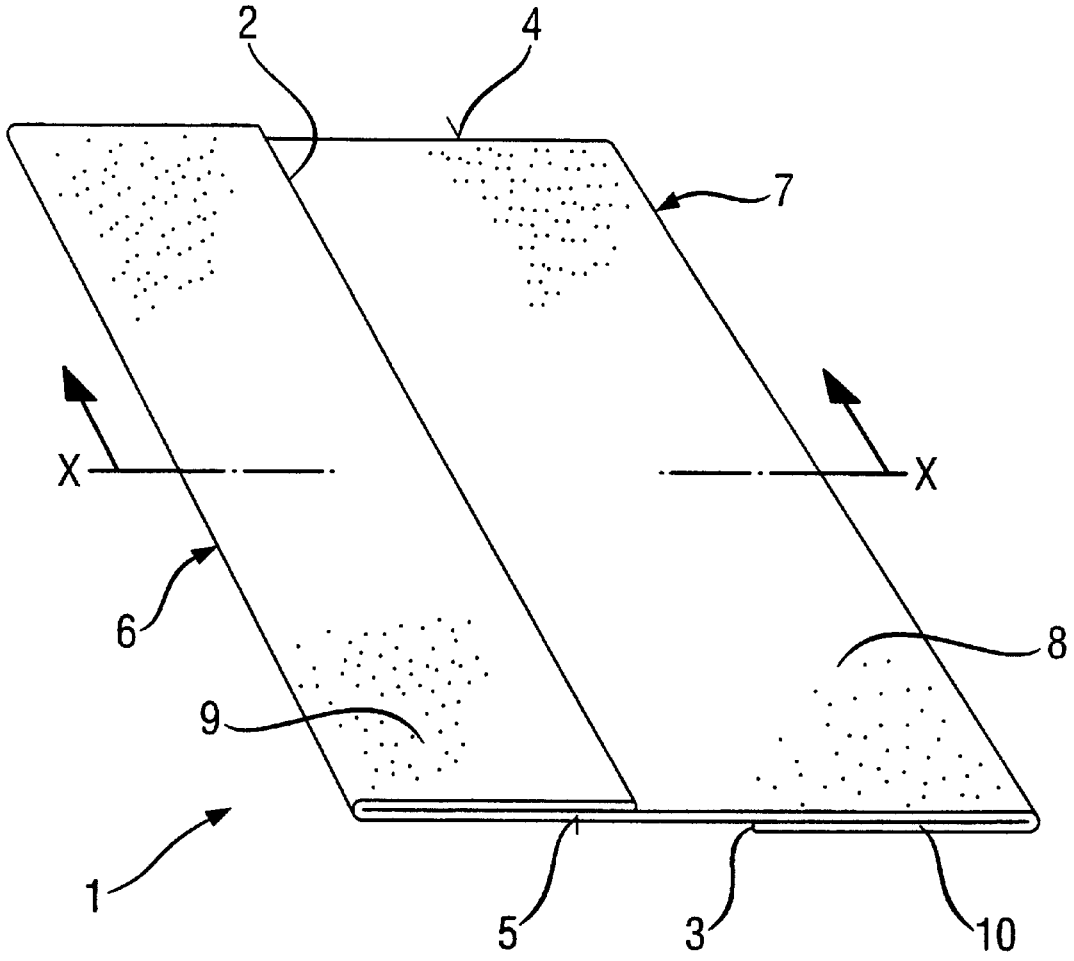
FIG. 1: Depicts a perspective view of a z-folded wet wipe.

According to the present invention the wet wipe comprises a substrate which is coated or impregnated with a liquid composition. The substrate may be woven or nonwoven, foam, sponge, battings, balls, puffs or films, most preferably a nonwoven and may be composed or natural or synthetic fibres or mixtures thereof. Preferably, the fibre compositions are a mixed of hydrophilic fibre material such as viscose, cotton, or flax and a hydrophobic fibre material such as polyethylene tetraphthalate (PET) or polypropylene (PP) in a ratio of 20%–80% hydrophilic and 80%–20% hydrophobic material by weight. Two particularly preferred compositions are 50% viscose/50% PP and 50% viscose/50% PET. The substrate preferably has a basis weight of at least 20 $gm^{-2}$ and preferably less than 150 $gm^{-2}$, and most preferably the base weight is in the range of 20 $gm^{-2}$ to 70 $gm^{-2}$, more preferably from 50 $gm^{-2}$ to 65 $gm^{-2}$. The substrate may have any caliper. Typically, when the substrate is made by a hydroentangling process, the average substrate caliper is less than 0.8 mm. More preferably the average caliper of the substrate is from 0.1 mm to 0.4 mm. The substrate caliper is measured according to standard EDANA non woven industry methodology, reference method # 30.4-89. The bulk density of the substrate is preferably not more than 1.0 $g/cm^3$, preferably not more than 0.9 $g/cm^3$, most preferably not more than 0.7 $g/cm^3$.

In addition to the fibers used to make the substrates, the substrate can have other components or materials added thereto as known in the art. The types of additives desirable will be dependent upon the particular end use of the substrate contemplated. For example, in wet wipe products such as moist toilet paper, paper towels, facial tissues, baby wipes and other similar air laid products, high wet strength is a desirable attribute. Thus, it is often desirable particularly for cellulose based substrates to add chemical substances known in the art as wet strength resins. A general dissertation on the types of wet strength resins utilized in the paper art can be found in TAPPI monograph series No. 29, Wet Strength in Paper and Paperboard, Technical Association of the Pulp and Paper Industry (N.Y., 1965). In addition to wet strength additives, it can also be desirable to include certain dry strength and lint control additives known in the art such as starch binders. Furthermore, the substrate may also comprise agents to improve the optical characteristics of the substrate material such as opacifying agents, for example titanium dioxide.

According to the present invention the substrate may be produced by any methods known in the art. For example nonwoven substrates can be formed by dry forming techniques such as air-laying or wet laying such as on a paper making machine. Other nonwoven manufacturing techniques such as melt blown, spun bonded, needle punched and spun laced methods may also be used. A preferred method is hydroentangling.

According to the present invention a stacking configuration for wet wipes is provided, which results in the improved ease of dispensation and separation of a single wipe from the wet wipe stack and easily recognition of the location of the leading edge of each subsequent wipe.

Figure 2:
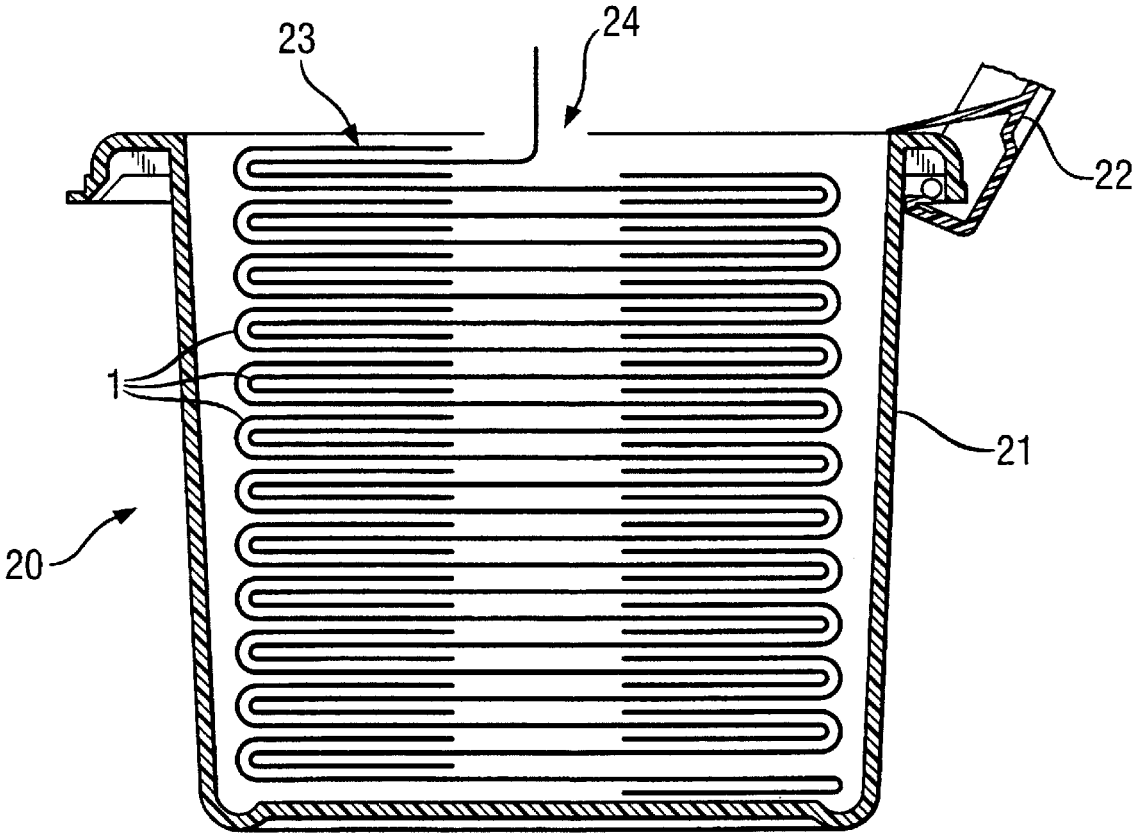
FIG. 2: Is a cross sectional schematic illustration of a stack of folded and interleaved wet wipes in a dispensing container.

The present invention will now be described with reference to the figures. FIG. 1 provides a perspective view of a single folded wet wipe 1. FIG. 2 is a cross sectional illustration of a stack of folded interleaved wipes 23 according to the present invention housed in a container 20. The container 20 includes a tub portion 21 and a lid 22, pivotably joined to the tube portion, by for example a hinge mechanism and a dispensing orifice 24. In an alternative embodiment, the wipes can also be stacked and then packaged in a moisture impervious wrapper, such as a foil or laminated polymeric film wrapper, to provide a refill package for use in refilling such a container.

According to the present invention the stacking configuration comprises a first and a second assembly of wipes which are interleaved with one another. Referring to FIGS. 1–3, each folded wipe 1 in each assembly extends lengthwise from a first, leading end edge 2, to a second, trailing end edge 3. The folded webs also have side edges 4 and 5 which extend lengthwise from the first leading end edge 2 to the second trailing end edge 3. Each folded wipe 1 has at least two folds thereby providing three panels. As used herein a panel is a portion of a wipe extending between two folds, or between a fold and an edge end.

The first panel fold 6 is generally parallel to the leading edge 2, and generally perpendicular to the side edges 4, 5. The first panel fold 6 is spaced lengthwise from the leading edge 2 to provide a leading edge panel 9 extending between the first panel fold 6 and the leading edge 2. The second panel fold 7 is generally parallel to, and spaced lengthwise from, the first panel fold 6, thereby providing a central panel 8 joined to the leading edge panel 9, at the first panel fold 6, and extending between the first panel fold 6 and the second panel fold 7. The trailing edge panel 10 is joined to the central panel 8 at the second panel fold 7, and extends between the second panel fold 7 and the trailing edge 3. According to the present invention the wipes are folded at the first and second panel folds 6 and 7, to provide the corresponding leading edge panel, central panel, and trailing edge panels 9, 8 and 10. The wipes can thus be folded into a number of configurations prior to interleaving. This is clearly demonstrated with reference to the respective surfaces of each of the panels as indicated in FIG. 3.

Figure 3A:
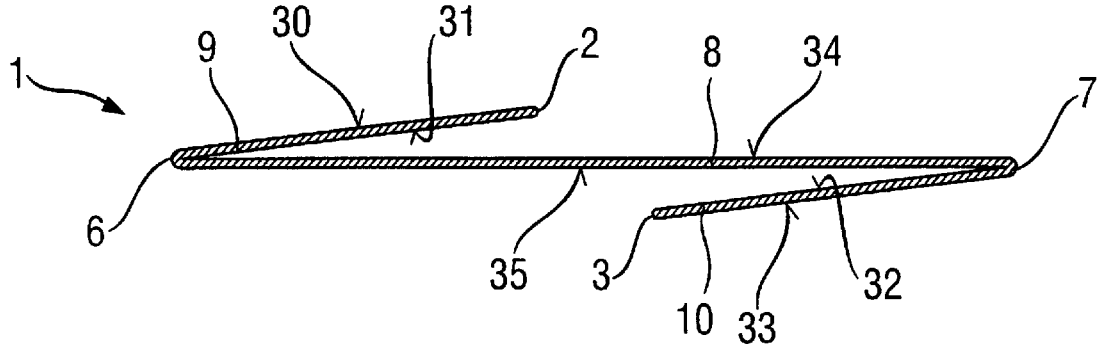
FIG. 3*a*: Is a cross sectional illustration taken along line x—x in FIG. 1 showing a wipe having a leading edge panel 2, a central panel 4 and a trailing edge panel 3 and folded in a Z fold configuration.

In FIG. 3, each wipe has a first upper surface leading edge panel 30, a second lower surface leading edge panel 31, a first upper surface trailing edge panel 32, a second lower surface trailing edge panel 33, a first upper surface central panel 34 and a second lower surface central panel 35. The leading edge panel and the trailing edge panel may thus be provided by the first panel fold and the second panel fold respectively such that the panel rests on the upper facing surface of the central panel or the lower facing surface of the central panel. As exemplified in FIGS. 1 and 3*a*, the leading edge panel 9 is adjacent to and overlies a portion of the upper facing surface of the central panel 8 and the trailing edge panel is adjacent to and underlies a portion of the lower facing surface of the central panel 8 thereby providing a so called reversed Z folded wipe. Alternatively, the wipes may be folded so as to provided a Z fold configuration. In yet another alternative both the leading edge panel and the trailing edge panel of each wipe maybe folded such that they are both adjacent and overlie a portion of the upper surface of the central panel. Preferably the wipes of the first and second assemblies are folded so as to provide mirror images of one another, for example whereby the first assembly of wipes are folded in a Z fold and the wipes of the second assembly are folded in a reversed Z fold.

Figure 3B:
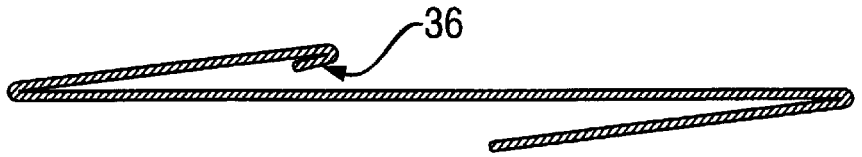
FIG. 3*b*: Is a cross sectional illustration of a folded wipe having a lip 36 on the leading edge panel.

Furthermore, in addition to the leading edge panel, central panel and trailing edge panel described herein above, each wipe may also have further additional panels. In particular, the leading edge panel and or the trailing edge panel may also be provided with an additional fold so as to provide a leading edge panel lip or a trailing edge panel lip as illustrated in FIG. 3*b*. Such a lip is formed by providing the leading edge panel or the trailing edge panel with a panel lip fold which is adjacent to and spaced from the leading or trailing edge of the folded substrate to provide a lip extending between the panel lip fold and the end edge. The panel lip fold may be folded onto the lower surface of the leading edge panel such that the leading end edge is below the leading edge end panel. This configuration is particularly beneficial in facilitating grasping of the edge. Alternatively, the leading edge panel may be folded such that the leading end edge rests on the upper surface of the leading edge panel. The lip may also be positioned on the upper or lower surface of the trailing edge panel. The lip typically extends from the leading or trailing edge from between 4 cm to 0.1 cm, preferably from 2 cm to 0.25 cm to the leading edge panel lip fold or the trailing edge panel lip fold.

According to the present invention, the overall dimensions of the substrate material and the panels thereof is dependent on the intended application of the wipe and can be selected accordingly. Preferably the ratio of the lengths of the leading edge panel to central panel to trailing edge panel is from 1:2:1 to 1:5:1 and most preferably the ratio is 1:3:1. More preferably the ratio of the lengths of the panels of the wipes of the first and second assembly of wipes are identical and most preferably the leading and trailing edge panels are both approximately one quarter the total length of the wipe. In one non limiting, illustrative example wherein the wipe may be utilised as a baby wipe, each folded wipe 1 can have an unfolded length of from 10 cm to 30 cm as measured lengthwise from the leading end edge 2 to the trailing end edge 3. For each folded wipe 1, the spacing between the first panel fold 6 and the second panel fold 7 can be from 2 cm to 7 cm, while the lengths of the leading edge panel 9 and trailing edge panel 10 can be from 2 cm to 7 cm. In a preferred embodiment the spacing between the first panel fold 6 and the leading end edge 2 is more preferably from 3 cm to 6 cm, and even more preferably between about 3 cm and 5 cm. The spacing between the first panel fold 6 and the second panel fold is more preferably from 3 cm to 12 cm, and even more preferably between about 10 cm and 12 cm. The spacing between the second panel fold 7 and the trailing edge is more preferably from 3 cm to 6 cm, and even more preferably between about 3 cm and 5 cm.

According to the present invention and with reference to the embodiments illustrated in FIGS. 4*a*, 4*b*, 4*c* and 4*d*, an essential feature of the stacking configuration is that each of the first assembly of folded wipes 40 are interleaved with each of the second assembly of folded wipes 41.

For example wipe x of the first assembly of wipes is folded in a reversed Z fold and interleaved between a Z folded wipe x of the second assembly of wipes. Similarly wipe x of the second assembly of wipes is interleaved between wipe y of the first assembly of wipes and, wipe y of the first assembly of wipes is interleaved with wipe y of the second assembly of wipes and so on. In this manner, commencing with the first assembly wipe x, at least a portion of said central panel 42*x* and at least a portion of said trailing edge panel 43*x* of each of said first assembly of wipes 40 are interleaved with wipe x of the second assembly of wipes between at least a portion of said leading edge panel 51*x* and at least a portion of said central panel 52*x* of each of said second assembly of wipes 50. Similarly, at least a portion of said central panel 52*x* and at least a portion of said trailing edge panel 53*x* of each of said second assembly of wipes 50, are interleaved between at least a portion of said leading edge panel 41*y* and at least a portion of said central panel 42*y* of each of said first assembly of wipes 40.

According to the present invention another essential feature of the stacking configuration is related to the relative lengths of the panels of each of the wipes of the first and second assemblies. Accordingly, it has been found that the length of the leading edge panel or the trailing edge panel of each wipe for example wipes x of said first assembly of wipes, is no more than 50% of the length of the corresponding central panel. Similarly, the length of the leading edge panel or said trailing edge panel of each wipe of said second assembly of wipes, is no more than 50% the length of the corresponding central panel. Hence, the leading and trailing edge panels of each of the first and second assemblies of wipes may be of any length provided that the sum of the length of the leading edge panel and the length of the trailing edge panel of any wipe is not greater than the length of the corresponding central panel of the wipe. Preferably however, the lengths of the panels of all of the wipes in each assembly and more preferably the corresponding panels in both first and second assemblies are of substantially identical dimensions.

Wet wipes stacked as described herein above result in superior dispensation than wipes stacked according to the prior art. Whilst not wishing to be bound by theory it has been found that the improved dispensing is related to the combination of the specific interleaved folding configuration between the first and second assemblies of wipes and the specific area of overlap between the panels of the wipes.

By the utilisation of the herein above described interleaving configuration the removal of the uppermost wipe, for example wipe x of the first assembly, from the interleaved stack will cause the agitation of the leading edge panel of the adjacent wipe x of the second assembly from the stack. This thereby facilitates the identification of the location of the leading edge of the adjacent wipe to the consumer. Furthermore, it has been found that the area of overlap between the leading edge panel of the adjacent wipe (i.e. wipe x of the second assembly of wipes) and the central panel or trailing edge panel of the uppermost wipe, (i.e. wipe x of the first assembly of wipes) ensures that the required amount of length of the substrate material of the wipe x of the second assembly is raised and separated from the stack. The area of overlap between the central panel of the adjacent wipe (x of the second assembly) and the trailing edge panel or the central panel of the uppermost wipe (x of first assembly) appear to be of lesser importance. Hence, the positioning of the first and second panel folds and the relative lengths of the leading and trailing edge panels to the central panel is of critical importance. However, the improved dispensation provided by the present invention may also involve other effects and interactions in addition to or instead of the hypothesis given, and hence no reliance should be placed thereon.

Figure 4A:
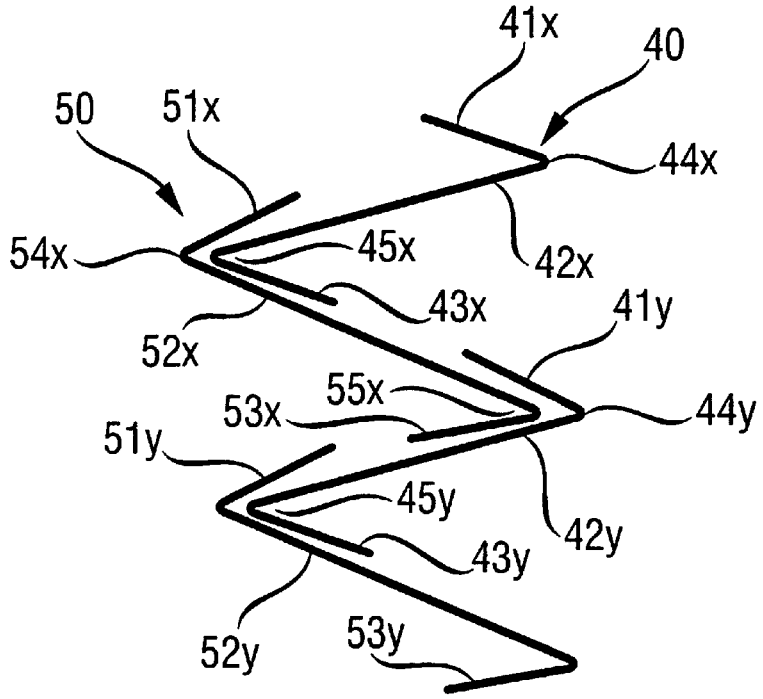
FIGS. 4*a*, 4*b*, 4*c* & 4*d*: Cross sectional illustration of 4 embodiments of folding and interleaving configurations for wet wipes according to the present invention.

Further in addition to the dispensing improvement, the interleaving configuration of the present invention particularly the embodiment illustrated in FIG. 4*a*, also ensures that the majority of the substrate material of each wipe in the stack is positioned in the horizontal plane. This reduces the tendency of the stack to produce ridges or grooves of substrate material. Moreover, the stacking configuration also reduces the tendency of the liquid composition to become unevenly distributed throughout the stack.

The further details of the invention will now be described with reference in turn to each of the embodiments 4*a*, 4*b*, 4*c* and 4*d*.

FIG. 4*a*, depicts a most preferred stacking configuration of the present invention. The configuration comprises a first assembly of wipes 40 folded in a Z configuration interleaved with a second assembly of wipes folded in a reversed Z fold configuration. Thereby, a portion of the central panel 42*x* (42*y*) of each wipe of the first assembly 40 is in contact with a portion of the leading edge panel 51*x* (52*x*) of each wipe of the second assembly 50, such that substantially all of one of the surfaces of the leading edge panel 51*x* (51*y*) of each of the wipes of the second assembly 50 is in contact with a portion of the central panel 42*x* (42*y*) of each of the wipes of the first assembly 40. In this embodiment the leading edge panel 41*x* (41*y*) and the trailing edge panel 43*x* (43*y*) of each of said first assembly of wipes 40 are both no more than 50% the length of said corresponding central panel 42*x* (42*y*) and are substantially equal in length. Correspondingly, the leading edge panel 51*x* (51*y*) and the trailing edge panel 53*x* (53*y*) of each of said second assembly 50 of said wipes are both not more than 50% the length of said corresponding central panel 52*x* (52*y*) and are substantially equal in length. Furthermore, the lengths of the leading edge panel 41*x* (41*y*), the trailing edge panel 43*x* (43*y*) and the central panel 42*x* (42*y*) of the each of the wipes of the first assembly 40 are substantially equal in length to the lengths of the corresponding leading edge panel 51*x* (51*y*), trailing edge panel 53*x* (53*y*) and central panel 52*x* (52*y*) of the second assembly of wipes 50. In particular, in the embodiment depicted in 4*a* the leading edge of each of said first assembly of wipes and each of said second assembly of wipes is approximately a quarter of the total length of each of said wipes.

Figure 4B:
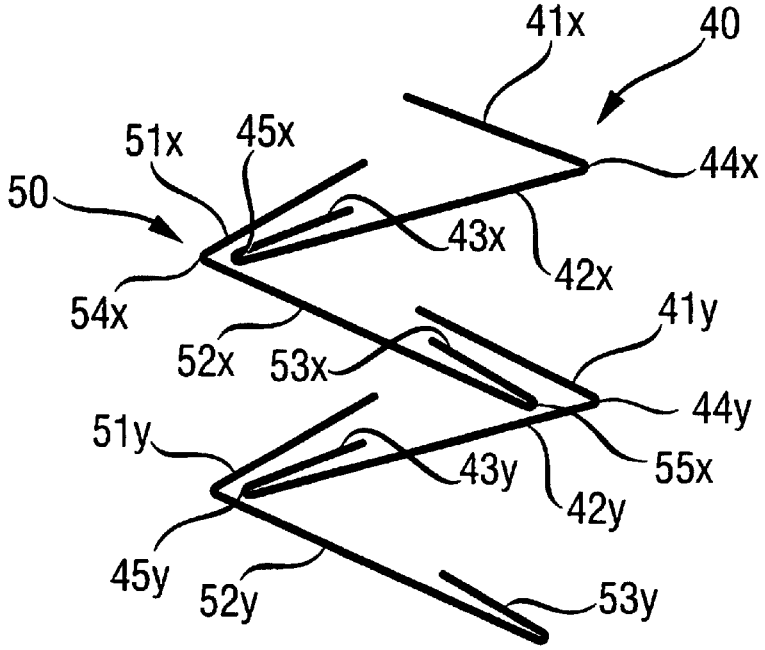

The embodiment depicted in FIG. 4*b*, is identical to that of 4*a* in terms of length of the respective panels. However in this embodiment, the wipes of both the first and second assemblies are folded such that the leading edge panel and the trailing edge panel of the wipes is adjacent to the upper surface of the central panel of the corresponding wipe prior to interleaving. Hence, after interfolding according to the present invention a portion of the central panel 42*x* (42*y*) of each wipe of the first assembly 40 is in contact with a portion of the central panel 52*x* (52*y*) of each of the wipes of the second assembly 50 and a portion of the trailing edge panel 53*x* (53*y*) of the wipes of the second assembly being in contact with the leading edge panel 41*y* of the wipes of the first assembly 40. Similarly, a portion of the trailing edge panel 53*x* of each wipe of the second assembly is in contact with a portion of the leading edge panel 41*y* of each wipe of the first assembly and a portion of the central panel 52*x* of each wipe of the second assembly is in contact with a portion of the central panel 42*y* of each wipe of the first assembly of wipes.

Figure 4C:
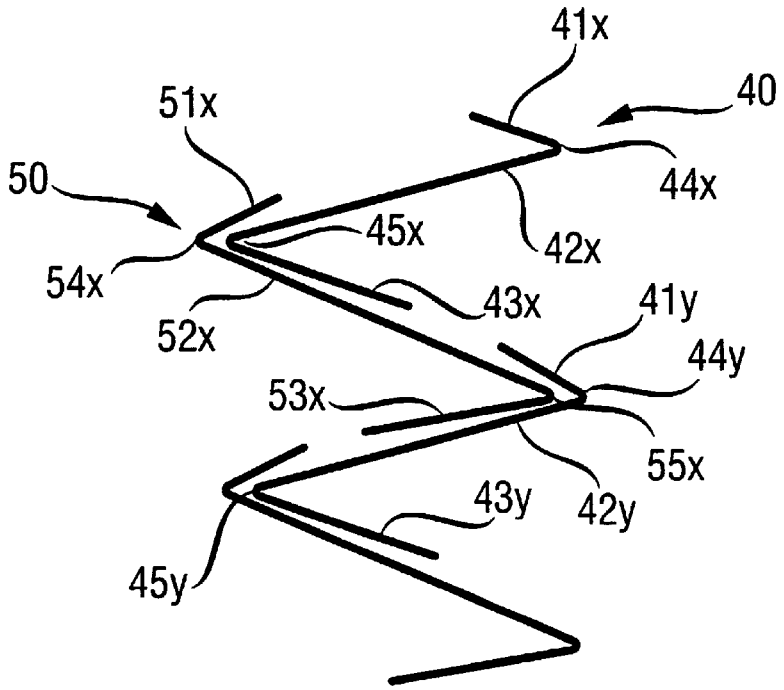
Figure 4D:
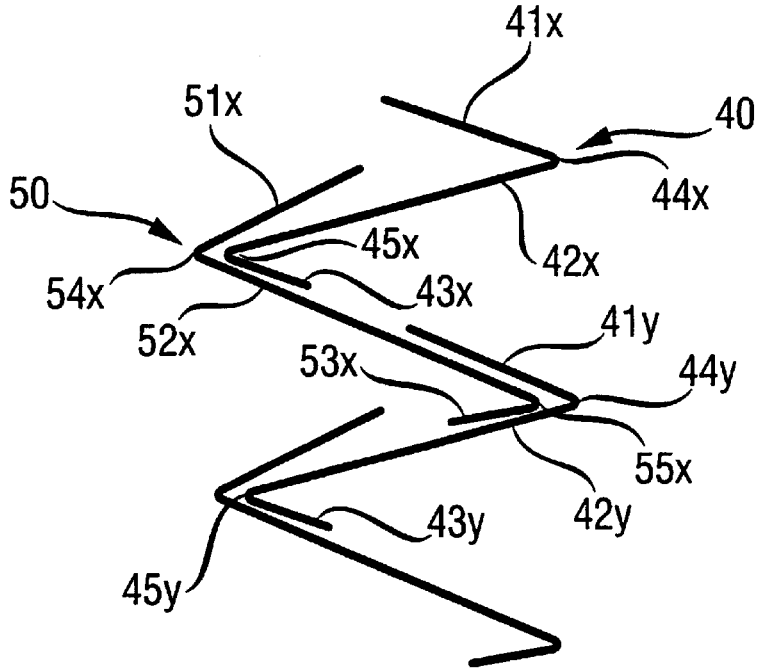

The embodiments according to FIGS. 4*c* and 4*d* depict a stacking configuration wherein the wipes of the first assembly 40, are folded in a Z configuration and are interleaved with a second assembly of wipes 50 folded in a reversed Z fold. However in these embodiments the lengths of the leading and trailing edge panel of the wipes of each of the respective assemblies are not equal. In the embodiment depicted in 4*c*, the length of the trailing edge panel of the wipes of both the first and second assemblies is over 50% the length of the central panel and is in fact about 60% the length of the central panel of each of the wipes of both the first and second assemblies. Consequently, the length of the leading edge panel of each of the wipes of both first and second assemblies is less than 50% the length of the central panel and is about 30%. In the embodiment depicted in 4*d*, the length of the leading edge panel of each of the wipes of both the first and second assemblies is over 50% and is about 60% of the length of the central panel of each of the wipes of both the first and second assemblies. Correspondingly, the length of the trailing edge panel of each of the wipes is less than 50%, and is about 30% of the length of the central panel.

In a particularly preferred embodiment according to the present invention, as depicted for example in FIG. 4*a*, the second panel fold 44*x* of each of the wipes of the first assembly should not be in direct contact with the first panel fold 54*x* of each of the adjacent wipes of the second assembly of wipes. Similarly, the second panel fold 55*x* of each of the wipes of the second assembly should not be contact with the first panel fold 44*y* of the adjacent wipes of the first assembly. Preferably, there should be a distance between the fold lines of at least 1 mm, preferably from between 1 mm to 5 mm, and most preferably from between 1 mm and 3 mm. This is because it is believed that contact between two adjacent folds of two adjacent wipes (x of the first and second assemblies) hinders the ability of the uppermost wipe to be separated from the adjacent wipe and cause too much of the substrate material of the adjacent wipe to be separated from the stack.

In another preferred embodiment of the present invention it is also preferable to provide the leading edge or panel with a visual and or tactile indicator. Such indicators further assist in the location of the leading edge itself by the consumer. Visual indicators may be provided for example in the form of a thin coloured strip or band printed on the surface of the leading edge panel in the vicinity of the edge itself.

A particularly preferred means for providing an edge indicator is by the use of a non linear edge such as a repeating sine wave or a repeating zig-zag pattern. Such non linear patterns may extend partially along the length of the edge in a continuous or intermittent manner or more preferably extend substantially along the entire length of the edge of the wipe. The provision of such an edge provides both a visual and tactile edge location indicator. Such mechanisms further promote ease of dispensation of the wipes.

According to the present invention, the substrate material is typically impregnated or coated with a liquid composition. An advantage of the present invention is that the stacking configuration allows a variety of composition to be used with the substrate material without significant impact on the dispensing mechanism. This is not only useful in allowing the nature of the composition to be varied, but also allows the loading of the composition throughout the stack to be varied in order to combat the composition settling at the base of the stack. According to the present invention the term liquid composition refers to any composition which is in a liquid form when the wipe is in contact with the surface. Typically, the composition may be aqueous, alcohol based or an emulsion, either a waterin-oil or an oil-in-water or a multiple emulsion, preferably the emulsion is a oil-in-water emulsion. The emulsion may also comprise a lipid phase which can be broken by the application of minimal pressure for example by wiping the skin. Typically, the composition will comprise from 2% to 50% by weight of said composition of actives and from 50% to 98% water, preferably deionised or distilled. Of the active component, preferably 2% to 20% are present in the oil phase and the remainder are present in the aqueous phase.

According to the present invention the wet wipes are provided with an emulsion composition comprising a oil phase in the range of 1% to 20%, preferably 2% to 10%, by weight of the composition. Advantageously, the oil based phase is derived from natural resources such as from vegetable or animal oils or may be synthetic or any mixtures thereof. Suitable vegetable and animal oils for use herein include waxes such as beeswax, lanolin, candelilla, and oils such as glycerine esters and glycerine ethers, fatty acid alcohols, fatty acid esters and fatty acid ethers such as caprylic and capric triglycerides and octylpalmitate. Suitable mineral oils include petroleum based oils such as paraffin and petroleum jelly. Synthetic oils for use herein include ethylenic polymers for example polyethylene wax or silicone based oils. Suitable silicon oils include polydimethylsiloxanes, volatile cyclomethicones, dimethiconols, siloxysilicates and amino- and phenyl derivatives of siloxanes and mixtures thereof. Examples include dimethicone (Dow Corning 200 Fluids), cyclomethicone and dimethiconol (Dow Corning 1401 Fluid), cetyl dimethicone (Dow Corning 2502 Fluid), dimethicone and trimethylsiloxysilicate (Dow Corning 593 Fluid), cyclomethicone (Dow Corning 244, 245, 344 or 345 Fluid), phenyl trimethicone (Dow Corning 556 Fluid), or combinations thereof.

The oil-in-water emulsions typically require emulsifying agents. The emulsifying agents which may be used in the present invention are preferably capable of primary emulsification of oil-in-water emulsions. The emulsifying agent is present in the range of 0.02% to 5.0%, preferably 0.02% to 3.0%, by weight of the composition.

In a preferred embodiment the emulsifying agent is a polymeric type of emulsifying agent such as a copolymer of C10–C30 alkyl acrylates and one or more monomers of acrylic acid, methylacrylic acid or one of their simple esters cross linked with an allyl ether of sucrose or an allyl ether of pentaerythritol. The emulsifying agents which are thus useful in the present invention include Ceteareth-12, Ceteareth-20 or Pemulen TR1 and TR2 which are available from B.F. Goodrich company of the USA. However, other known emulsifying agents such as ethoxylated fatty alcohols, glycerine esters of fatty acids, soaps, sugar derived agents are also suitable for use herein. Other useful emulsifying agents include those disclosed in detail in EP-A-328 355.

According to the present invention the composition may comprise a stability agent or preservative. Stability agents suitable for use herein include phenoxyethanol preferably present in the range of from 0.1 to 1.0%, sodium benzoate, potassium sorbate, methylparaben, propylparaben, ethylparaben, butylparaben, sodium benzoate, potassium sorbate, benzalkonium chloride, and disodium salt ethylenediamine tetraacetic acid (hereinafter referred to as EDTA) or other EDTA salts (sequestrenes). Sequestrene is a series of complexing agents and metal complexes general of ethylenediamine-tetraacetic acid and salts. The total quantity of stability agents should be in the range of 0.1% to 4.0% by weight of the composition.

The composition of the present invention may further comprise from 0.02% to 5.0% by weight of said composition of an emollient or moisturiser. Preferably the emollient is water soluble and includes polyhydric alcohols, such as propylene glycol, glycerin, and also water soluble lanolin derivatives.

Further optional ingredients which may be used in the present invention include, anti fungal agents, antibacterial agents, skin protectants, oil soluble cleansing agents, water soluble surfactants or detergents, preferably nonionic or amphoteric, pH adjusters, perfumes, fragrances and the like.

In order for the emulsion to provide the wet wipe with good cleaning performance the delivered viscosity should be less than 500 mPas, preferably in the range of 300 to more than 100 mPas and most preferably in the range of 180 to 120 mpas.

In preparing wet wipe products according to the present invention, the composition is applied to at least one surface of the substrate material. The composition can be applied at any time during the manufacture of the wet wipe. Preferably the composition can be applied to the substrate after the substrate has been dried. Any variety of application methods that evenly distribute lubricious materials having a molten or liquid consistency can be used. Suitable methods include spraying, printing, (e. g. flexographic printing), coating (e. g. gravure coating or flood coating) extrusion whereby the composition is forced through tubes in contact with the substrate whilst the substrate passes across the tube or combinations of these application techniques. For example spraying the composition on a rotating surface such as calender roll that then transfers the composition to the surface of the substrate. The composition can be applied either to one surface of the substrate or both surfaces, preferably both surfaces. The preferred application method is extrusion coating.

The composition can also be applied non uniformly to the surfaces of the substrate. By non uniform it is meant that for example the amount, pattern of distribution of the composition can vary over the surface of the substrate. For example some of the surface of the substrate can have greater or lesser amounts of composition, including portions of the surface that do not have any composition on it. The composition is typically applied in an amount of from about 0.5 g to 10 g per gram of substrate, preferably from 1.0 g to 5 g per gram of substrate, most preferably from 2 g to 4 g per gram of dry substrate.

Preferably, the composition can be applied to the substrate at any point after it has been dried. For example the composition can be applied to the substrate prior to calendering or after calendering and prior to being wound up onto a parent roll. Typically, the application will be carried out on a substrate unwound from a roll having a width equal to a substantial number of wipes it is intended to produce. The substrate with the composition applied thereto is then subsequently severed to produce individual wipes.

What is claimed is:

1. A stacking configuration for wet wipes, said configuration comprising a first assembly of wipes and a second assembly of wipes, each of said wipes comprising a substrate and a liquid composition and, each of said wipes extending lengthwise from a first leading end edge to a second trailing end edge, and each of said wipes having two folds thereby providing, a leading edge panel, a central panel and a trailing edge panel, and wherein said first assembly of wipes are interleaved with said second assembly of wipes, such that at least a portion of said central panel and at least a portion of said trailing edge panel of each of said first assembly of wipes are interleaved between at least a portion of said leading edge panel and at least a portion of said central panel of one wipe of said second assembly of wipes and at least a portion of said central panel and at least a portion of said trailing edge panel of each of said second assembly of wipes are interleaved between at least a portion of said leading edge panel and at least a portion of said central panel of one wipe of said first assembly of wipes, whereby the length of said leading edge panel or said trailing edge panel of each of said first assembly of wipes is no more than 50% of the length of the corresponding central panel and the length of said leading edge panel or said trailing edge panel of each of said second assembly of wipes is no more than 50% of the length of the corresponding central panel.

2. A stacking configuration for wet wipes according to claim 1, wherein the lengths of said leading edge panel and said trailing edge panel of each of said first assembly of wipes are both no more than 50% of the length of said corresponding central panel and wherein said leading edge panel and said trailing edge panel of each of said second assembly of said wipes are both not more than 50% the length of said corresponding central panel.

3. A stacking configuration for wet wipes claim 1, wherein the lengths of said leading edge panel and said trailing edge panel of each of said first assembly of wipes are substantially equal in length and wherein said the lengths of the leading edge panel and said trailing edge panel of each of said second assembly of wipes are substantially equal in length.

4. A stacking configuration for wet wipes according to claim 3, wherein said leading edge panel of each of said first assembly of wipes is substantially equal in length with said leading edge panel of each of said second assembly of wipes.

5. A stacking configuration for wet wipes according to claim 4, wherein the ratio of the lengths of said leading edge panel of each of said first assembly of wipes and each of said second assembly of wipes to the length of said trailing edge of each of said first assembly of wipes and each of said second assembly of wipes is the ratio from 1:2:1 to 1:5:1.

6. A stacking configuration for wet wipes according to claim 4, wherein said leading edge panel of each of said first assembly of wipes and each of said second assembly of wipes is approximately one quarter of the total length of each of said wipes.

7. A stacking configuration for wet wipes to claim 6, wherein said each wipe of said first assembly of wipes is folded in a reversed Z fold configuration and each wipe of said second assembly of wipes is folded in a Z configuration.

8. A stacking configuration according to claim 1, wherein said each wipe of said first assembly of wipes and each wipe of said second assembly of wipes have a first panel fold and a second panel fold and wherein the distance between the first panel fold of each wipe of the first assembly and the second panel fold of one wipe of the second assembly of wipes is between 1 mm and 5 mm and, wherein the distance between the second panel fold of each wipe of said first assembly of wipes and the first panel fold of one wipe of the second assembly of wipes is between 1 mm and 5 mm.

9. A stacking configuration for wet wipes according claim 1, wherein said wipes are housed in a container, said container having a dispensing orifice.

10. Wet wipes according to claim 1, wherein said substrate is a nonwoven.

11. Wet wipes according to claim 1, wherein said substrate comprises hydrophobic fibres selected from polyethylene terephthlate, polypropylene or mixtures thereof.

12. Wet wipes according to claim 1, wherein said substrate comprises hydrophilic fibres selected from cotton, viscose, flax or mixtures thereof.

13. Wet wipes according to claim 1, wherein said liquid composition is a oil-in-water emulsion and said wet wipe comprises from 0.5 g to 10 g of said emulsion per gram of said dry weight substrate.

* * * * *